United States Patent [19]

Hendricks et al.

[11] Patent Number: 4,964,875

[45] Date of Patent: Oct. 23, 1990

[54] PROCESS FOR AFTER-TREATMENT OF DYED POLYAMIDE TEXTILE MATERIALS WITH POLYURETHANE CONTAINING QUATERNARY AMMONIUM GROUPS

[75] Inventors: Udo W. Hendricks, Odenthal; Josef Sanders, Cologne; Ergun Tamer, Leverkusen, all of Fed. Rep. of Germany

[73] Assignee: Bayer Aktiengesellschaft, Leverkusen, Fed. Rep. of Germany

[21] Appl. No.: 349,742

[22] Filed: May 9, 1989

[30] Foreign Application Priority Data

May 17, 1988 [DE] Fed. Rep. of Germany ..... 3816699

[51] Int. Cl.[5] ..... D06P 1/52; D06P 3/06; D06P 5/08; C08G 18/83

[52] U.S. Cl. ..... 8/442; 8/554; 8/567; 8/606; 8/680; 8/917; 8/924

[58] Field of Search ..... 8/442, 554, 680

[56] References Cited

U.S. PATENT DOCUMENTS 4,098,772 7/1978 Bonk et al. ..... 528/49
4,362,874 12/1982 Kalk et al. ..... 8/442

FOREIGN PATENT DOCUMENTS 272941 6/1988 European Pat. Off. .
54-151689 11/1979 Japan .
1547958 7/1979 United Kingdom .

*Primary Examiner*—A. Lionel Clingman
*Attorney, Agent, or Firm*—Sprung, Horn, Kramer & Woods

[57] ABSTRACT

The invention relates to a process for after-treatment of anionically dyed natural and synthetic polyamide textile materials by means of polyurethanes containing quaternary ammonium groups.

12 Claims, No Drawings

PROCESS FOR AFTER-TREATMENT OF DYED POLYAMIDE TEXTILE MATERIALS WITH POLYURETHANE CONTAINING QUATERNARY AMMONIUM GROUPS

The invention relates to a process for after-treatment of anionically dyed natural and synthetic polyamide textile materials by means of polyurethanes containing quaternary ammonium groups.

Printed or dyed textile materials made of natural or synthetic polyamides frequently exhibit insufficient washfastness, in particular at elevated temperature, since some of the bound dyestuff is dissolved during washing.

The use of polyurethanes to eliminate these disadvantages is known.

Thus, Japanese Patent Application No. 54/151,689 has disclosed to use mixtures of urea with urethane resins containing isocyanate groups which have been blocked with hydrogen sulphite for improving the colour-fastness of dyed fabrics.

Japanese Patent Application No. 64/212,412 describes the use of dispersed or dissolved polyurethanes containing tertiary ammonium groups and blocked isocyanate groups for the treatment of fibre materials.

Polyurethanes containing quaternary ammonium groups are known per se (cf. D. Dieterich in Houben-Weyl, Vol. E 20, Part 2, p. 1687, Thieme-Verlag, Stuttgart 1987).

Polyurethanes which are suitable according to the invention are preferably obtained by reaction of (A) compounds containing tertiary amino groups and at least two hydroxyl groups with (B) polyisocyanates and (C) quaternizing agents.

The polyurethanes are soluble or dispersible in water.

Suitable compounds A) are in particular hydroxyalkylamines of the general formula

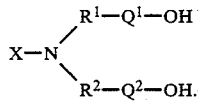

(I)

in which $Q^1$ and $Q^2$, independently of one another, denote a radical of the general formula

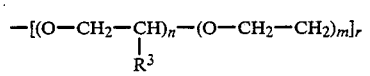

X denotes $C_1$–$C_{18}$-alkyl, $C_5$–$C_8$-cycloalkyl, $C_7$–$C_9$-aralkyl or a radical of the formula

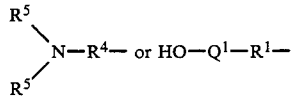

$R^1$, $R^2$ and $R^4$, independently of one another, denote $C_2$–$C_6$-alkylene, $C_5$–$C_8$-cycloalkylene or $C_7$–$C_9$-aralkylene, $R^3$ denotes hydrogen or methyl, $R^5$ denotes $C_1$–$C_{18}$-alkyl, $C_5$–$C_8$-cycloalkyl, $C_7$–$C_9$-aralkyl or a radical of the formula

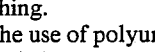

and m, n and r denote a number from 0 to 30, and bis(hydroxyalkyl)piperazines of the general formula

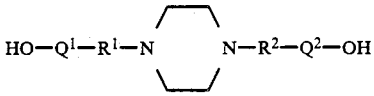

(II)

in which the symbols have the abovementioned meaning.

Examples of compounds of the general formula (I) are N-methyldiethanolamine, N-methyl-bis-(2-hydroxypropyl)-amine, N-ethyldiethanolamine, N-butyldiethanolamine, N-butyl-bis-(2-hydroxypropyl)-amine, N-octadecyldiethanolamine, N-butyl-bis-(2-hydroxybutyl)-amine, N-butyl-bis-(3-hydroxy-2-butyl)-amine, N,N-bis-(2-hydroxyethyl)-cyclohexylamine, N,N-bis-(2-hydroxypropyl)-cyclohexylamine, N-benzyl-diethanolamine, N-benzyl-bis-(2-hydroxypropyl)-amine, N,N-bis-(hydroxyethyl)- and N,N-bis-(2'-hydroxypropyl)-1-amino-3-dimethylaminopropane, N,N-bis-(hydroxyethyl)- and N,N-bis-(2'-hydroxypropyl)-1-amino-3-diethylaminopropane, N,N'-dimethyl-N,N'-bis-(2-hydroxyethyl)-ethylenediamine, N,N'-dimethyl-N,N'-bis-(2-hydroxypropyl)-1,3-propylenediamine, N,N'-dibutyl-N,N'-bis-(2-hydroxyethyl)-1,6-hexanediamine, N,N'-dicyclohexyl-N,N'-bis-(2-hydroxyethyl)-ethylenediamine, N,N'-dibenzyl-N,N'-bis-(2-hydroxyethyl)-ethylenediamine, tris-(2-hydroxyethyl)- and tris-(2-hydroxypropyl)-amine, N,N,N',N'-tetrakis-(2-hydroxyethyl)- and N,N,N',N'-tetrakis-(2-hydroxypropyl)ethylenediamine, -tetramethylenediamine, -hexamethylenediamine and reaction products thereof with ethylene oxide and/or propylene oxide.

Examples of compounds of the general formula (II) are N,N'-bis-(2-hydroxyethyl)-piperazine, N,N'-bis-(2-hydroxypropyl)-piperazine, N,N'-bis-(2-hydroxybutyl)-piperazine and reaction products thereof with ethylene oxide and/or propylene oxide.

The compounds (I) can also be reacted with the polyisocyanates in a mixture with other compounds (D) which are known in polyurethane chemistry and contain at least two Zerewitinoff active hydrogen atoms.

Examples of these mixed components (D) are, inter alia, known from DE-A No. 2,832,253, pages 11 to 20. They have molecular weights between about 60 and 10,000. Preferably, these are understood to mean, apart from compounds containing amino, thiol and/or carboxyl groups, compounds containing hydroxyl groups, in particular 2 to 8 hydroxyl groups, and having molecular weights between 800 and 6,000. Examples of suitable compounds are polyesters, polyethers, polythioethers, polyacetals, polycarbonates and polyesteramides containing 2 to 4 hydroxyl groups, such as are known per se for the preparation of homogeneous or cellular polyurethanes.

Particular preference is given to polyethers obtained by the addition reaction of one or more alkylene oxides (ethylene oxide and in particular propylene oxide) with dihydric or polyhydric "initiators" (for example propylene glycol, glycerol, sorbitol, formose or trimethylolpropane) and also polyethers which contain polyaddition products from diisocyanates obtained from hydrazine and/or diamines and/or glycols or polymers and/or graft polymers, preferably from styrene and acrylonitrile, in dispersed or dissolved form. Polyesters, including polycarbonates, of the type customarily used as soft segment are also suitable. The preferred compounds of this type have melting points below 60°, preferably below 45° C. Compounds containing hydroxyl groups and having a functionality of 2 are preferred.

Preferably, these are also understood to mean compounds which have molecular weights between 60 and 400 and contain at least two hydroxyl groups and/or amino groups and/or thiol groups and/or carboxyl groups and/or hydrazide groups and are known as chain-lengthening agents or crosslinking agents. As a rule, these compounds have 2 to 8, preferably 2 to 4, hydrogen atoms which are reactive towards isocyanates. Examples of suitable compounds are ethylene glycol, butane-1,4-diol, 2,2-dimethylpropanediol, trimethylolpropane, hydrazine, ethylenediamine, 3,3'-dimethyl-4,4'-diaminodicyclohexylmethane, 3,5-diethyl-2,4(and/or 2,6)-diaminotoluene or adipic dihydrazide or their mixtures.

In the reaction of (A) with (B), chain-terminating agents (E) can also be used.

Suitable examples are all monofunctional, preferably relatively low-molecular-weight (molecular weight up to 400) compounds having a group which is reactive towards NCO, for example monoalcohols, such as methanol, n-octanol, isopropanol, isooctyl alcohol or stearyl alcohol; primary or secondary monoamines, such as ethylamine, di-n-butylamine, di-isopropylamine, stearylamine, 4-amino-2,2,6,6-tetramethylpiperidine, acetic hydrazide, stearyl hydrazide, aniline or thiol compounds such as octanethiol.

Monofunctional compounds containing tertiary amino groups are particularly preferred. Examples of these are 1-amino-2-diethylaminoethane, 1-amino-3-dimethylaminopropane, 1-amino-3-diethylaminopropane, 4-amino-1-diethylaminopentane, furthermore 2-(dimethylamino)ethanol, 2-diethylaminoethanol, 2-dibutylaminoethanol, N-methyl-N-(2-dimethylaminoethyl)ethanolamine, N-methyl-N-(3-dimethylaminopropyl)ethanolamine, N-methyl-N-(2-dimethylaminoethoxyethyl)ethanolamine, N-(2-hydroxyethyl)-2-azabicyclo[2.2.1]heptane, N,N-bis-(3-dimethylaminopropyl)-N-(2-hydroxyethyl)amine and also reaction products thereof with ethylene oxide and/or propylene oxide.

Suitable starting components (B) are aliphatic, cycloaliphatic, araliphatic and aromatic polyisocyanates of the type described, for example, by W. Siefken in Justus Liebigs Annalen der Chemie, 562, pages 75 to 136. Aliphatic diisocyanates are preferred. Suitable examples are tetramethylene diisocyanate; hexamethylene diisocyanate; decamethylene diisocyanate; 1,3-di-(3-isocyanatopropoxy)-2,2-dimethylpropane; cyclohexane 1,4-diisocyanate; methylcyclohexane 2,4-diisocyanate; methylcyclohexane 2,6-diisocyanate; 1,3-diisocyanatocyclohexane, mixtures of methylcyclohexane 2,4-diisocyanate and methylcyclohexane 2,6-diisocyanate; dicyclohexylmethane 4,4'-diisocyaante; 1-isocyanato-3-isocyanatomethyl-3,5,5-trimethylcyclohexane (isophorone diisocyanate); 1,2-di-(isocyanatomethyl)cyclobutane; m- and p-xylylene diisocyanate and also $\alpha,\alpha,\alpha',\alpha'$-tetramethyl-m- and/or -p-xylylene diisocyanate or -hexahydroxylylene diisocyanate. In the case of cycloaliphatic diisocyanates, any desired stereoisomers or mixtures thereof can be used. It is of course also possible to use mixtures of these isocyanates.

When starting components having three and more Zerewitin-off-active hydrogen atoms are used, the use of monofunctional isocyanates may be advantageous or necessary. Suitable examples are isocyanatomethane, isocyanatoethane, isocyanatopropane, isocyanatobutane, isocyanatopentane, isocyanatohexane, 6-chlorohexyl isocyanate, stearyl isocyanate or benzyl isocyanate and also mixtures of these isocyanates.

The polyurethanes which are suitable according to the invention are prepared by reacting the starting components (A) and (B) and also, if used, starting components (D) and (E) by single-step or multi-step processes, in general maintaining an equivalent ratio of isocyanate groups to groups which are reactive towards isocyanate groups of 0.8:1 to 1:1, at temperatures from 20° to 150° C., preferably 50° to 100° C., in the absence or presence of inert solvents such as benzene, chlorobenzene, toluene, acetone, methyl ethyl ketone, ethyl acetate, tetrahydrofuran, dioxane, dimethylformamide, dimethyl sulphoxide or N-methylpyrrolidone.

In this reaction auxiliaries and additives of the customary type, for example water, catalysts, surface-active additives, reaction retardants, plasticizers or substances having a fungistatic or bacteriostatic action, stabilizers and light-stabilizers, can also be used.

The subsequent conversion of the tertiary amino groups into quaternary ammonium groups is carried out by reaction with quaternizing agents, preferably those which introduce a substituted or unsubstituted $C_1$–$C_4$-alkyl radical or a $C_7$–$C_9$-aralkyl radical into the molecule, at temperatures from 30° to 120° C., preferably 40° to 80° C., if desired using solvents such as alcohols, ketones or ethers, for example methanol, ethanol, isopropanol, acetone, acetonitrile, tetrahydrofuran. Examples of quaternizing agents are methyl chloride, methyl bromide, dimethyl sulphate, diethyl sulphate, benzyl chloride, ethylene chlorohydrin, p-toluenesulphonic esters, chloroacetic esters and epichlorohydrin.

It may be advantageous to quaternize only some of the tertiary nitrogen atoms present. Some of the tertiary nitrogen atoms can also be converted by protonation into a cationic charge state which allows dissolution or dispersion in water. Suitable examples are inorganic acids, such as hydrochloric, hydrobromic and hydriodic, perchloric, perbromic, sulphuric and phosphoric acid and also organic acids, such as formic, acetic, mono-, di- and trichloroacetic, propionic, lactic, methanesulphonic, benzenesulphonic or toluenesulphonic acid.

The relative amounts are chosen such that 0.5 to 10 equivalents, preferably 0.7 to 1.0 equivalents, of the quaternizing agent are used per tertiary amino group. The tertiary amino groups which have not been converted into quaternary ammonium groups are subsequently neutralized, preferably by the addition of one of the abovementioned inorganic or organic acids.

The process according to the invention for after-treatment of fibre materials by means of the polyurethanes described above and containing quaternary ammonium groups is carried out by methods known per se.

The textile materials used for the after-treatment can be wool, silk and synthetic polyamides, such as polymers of ε-caprolactam and polymers from dicarboxylic acid and diamines, for example from adipic acid and hexamethylenediamine. The textile materials can be present in the form of loose fibre, tops, yarns or pieced goods. The process is preferably used for after-treatment of dyed wool. This wool can be unchlorinated or chlorinated wool or wool which has been given a non-felting finish by prior treatment with a synthetic resin. Particularly good effects are obtained in the after-treatment of dyeings on chlorinated wool or wool which has been given a non-felting finish by prior treatment with a synthetic resin.

The chlorination of wool can be carried out continuously or batchwise by a conventional process using hypochlorous acid or chloroisocyanurate.

The non-felting finishing can be carried out by various known processes, for example by the HERCOSETT process. These processes, also known as superwash finishing, are chlorination processes and processes in which the fibre is treated with a resin, for example a polyurethane, polyacrylic, melamine/-polyalkyleneimine/epichlorohydrin or polyamide/epichlorohydrin resin.

Processes of this type are described, for example, in M. Bahra, Zeitschrift fur die gesamte Textilindustrie, 1964, No. 6, p. 519–522; G. Meier, Textilpraxis international, 1975, Volume 1, p. 76 to 79 and Volume 3, p. 304 to 306; R. R. D. Holt, Journal of the Society of Dyers and Colourists, 1975, No. 2, p. 38 to 44.

The polyurethanes which are suitable according to the invention are preferably added to the after-treatment liquors in the form of aqueous solutions, in which the amounts of the polyurethanes can vary within wide limits.

In general an addition of 0.5 to 6, preferably 1 to 4, % by weight, relative to the weight of the fibre material, has proven suitable.

The after-treatment of the textile material is advantageously carried out in such a manner that the dyed material, preferably wool which has already been given a non-felting finish, is introduced into an aqueous liquor containing the condensation products which are suitable according to the invention and having a pH between 6 and 10. The liquor is preferably adjusted to a pH of 8 to 10 by the addition of alkyaline compounds, for example ammonia or sodium carbonate.

The temperature of the treatment bath is raised to 50° to 80° C. over a period of 20 to 30 minutes and maintained at that temperature for 5 to 30 minutes. The material is then rinsed with cold water, acidified with acetic acid, dewatered and dried.

The after-treatment can be carried out, as described above, by the exhaust process or even continuously or semicontinuously by padding or spraying followed by heat treatment.

The effect of the polyurethanes which are suitable according to the invention and contain quaternary ammonium groups can be increased from case to case by the use of non-ionic, cationic or amphoteric interface-active substances. Substances of this type are, for example, ethylene oxide and/or propylene oxide adducts of fatty amines which may be quaternized and/or sulphated. They are known to one skilled in the art as levelling agents for wool dyestuffs.

The amount of these products used is 50 to 100%, preferably 70 to 80%, of the amount of the condensation products according to the invention.

Surprisingly, it has been found that by means of the process according to the invention the fastness properties of the dyed textile materials, in particular the wet fastness properties, such as perspiration fastness according to IWS-TM 174 (test method for alkaline perspiration fastness) and the wash fastness according to IWS-TM 193 (test method for wash fastness) can be improved significantly without any adverse effect on the rub fastness properties.

Examples of suitable dyestuffs are the dyestuffs customarily used for the dyeing of fibres containing polyamide groups, for example acid dyestuffs, metal complex dyestuffs, which can contain water-solubilizing groups, such as sulphonic acid or carboxyl groups or even sulphonamide or alkylsulphone radicals, and also reactive dyestuffs. They are described in more detail in the Colour Index. These dyestuffs, which otherwise have good fastness properties, produce on keratin-containing materials with a non-felting finish—in particular in the case of deep shades—dyeings having less favourable fastness properties.

The parts given in the examples and preparation procedures are by weight, unless stated otherwise. The names of the dyestuffs given refer to the names in Colour Index, 3rd edition, Volume 5 (1971).

EXAMPLE 1

93.5 parts of N,N-bis-(2-hydroxyethyl)-cyclohexylamine were dissolved in 120 parts of acetone, and 84 parts of hexamethylene diisocyanate were added dropwise at 50° to 60° C., and the mixture was then stirred at 50° to 60° C. for 10 hours. No more isocyanate could be detected by IR spectroscopy.

The reaction mixture was diluted with 100 parts of acetone, and 50 parts of dimethyl sulphate were added dropwise at 40° to 45° C. The mixture was subsequently stirred at 40° to 45° C. for 30 minutes and at 50° to 60° C. for 2 hours.

500 parts of water were added dropwise, and the acetone was distilled off at 30° to 40° C. in a waterpump vacuum.

This gave a clear reddish-brown solution having a solids content of 43% and a viscosity of 111.6 mPa.s at 20° C.

EXAMPLE 2

117 parts of N,N-bis-(2-hydroxyethyl)-benzylamine were dissolved in 80 parts of acetone, and 0.5 part of tin(II) octoate was added. 101 parts of hexamethylene diisocyanate were then added dropwise at 50° to 60° C. After stirring for five hours at 50° to 60° C., the IR spectrum shows that an NCO band was no longer present.

66 parts of dimethyl sulphate were added at 40° to 45° C. to 261 parts of the reaction mixture. The mixture was then diluted with 150 parts of water and stirred at 40° to 45° C. for 2 hours. After removal of the acetone by distillation in a waterpump vacuum, the residue was dissolved with 225 parts of 1-methoxy-2-propanol and 213 parts of water.

This gave a clear solution having a solids content of 28%.

EXAMPLE 3

47.6 parts of N-methyldiethanolamine and 0.15 part of tin(II) octoate were dissolved in 160 parts of acetone, and 67.2 parts of hexamethylene diisocyanate were added dropwise at 50° to 60° C. After stirring for five hours at 50° to 60° C., no more isocyanate groups could be detected by IR spectroscopy. 200 parts of 1,2-propanediol and 46 parts of benzyl chloride were added to the reaction mixture, and the mixture was stirred at 50° to 60° C. for 2 hours. After removal of the acetone by distillation in a waterpump vacuum, the mixture was stirred at 80° to 90° C. for 2 hours. The reaction mixture was diluted with 150 parts of water. About 150 parts of distillate were distilled off in a waterpump vacuum to remove any remaining traces of benzyl chloride and acetone.

This gave 385 parts of a yellowish clear reaction product having a solids content of 57%.

EXAMPLE 4

93.5 parts of N,N-bis-(2-hydroxyethyl)-cyclohexylamine were mixed with 80 parts of acetone, and 87 parts of a mixture of 2,4- and 2,6-diisocyanatotoluene (weight ratio 65:35) were added dropwise at 50° to 60° C. The mixture was then stirred at 55° to 60° C. for 4 hours until no more isocyanate groups could be detected by IR spectroscopy.

208 parts of the reaction mixture were diluted with 100 parts of acetone, and 50 parts of dimethyl sulphate were added at 40° to 50° C. After 30 minutes, 200 parts of water were added, and the mixture was stirred at 50° to 60° C. for 2 hours.

After removal of the acetone by distillation in a waterpump vacuum, the residue was mixed with 180 parts of 1,2-propanediol and 20 parts of water.

This gave a clear solution having a solids content of 47% and a viscosity of 698 mPa.s at 20° C.

EXAMPLE 5

97.5 parts of N,N-bis-(2-hydroxyethyl)-benzylamine were mixed with 100 parts of acetone, and 87 parts of a mixture of 2,4- and 2,6-diisocyanatotoluene (weight ratio 65:35) were added dropwise at 50° to 60° C. After stirring for four hours, no more isocyanate groups could be detected in the IR spectrum.

224 parts of the reaction mixture were diluted with 100 parts of acetone, and 49 parts of dimethyl sulphate were added at 40° to 50° C. After stirring for 30 minutes at 40° to 50° C., the mixture was diluted with 200 ml of water and stirring at 50° to 60° C. was continued for 2 hours.

After removal of the acetone by distillation in a water-pump vacuum, the residue was dissolved with 230 parts of 1,2-propanediol, 70 parts of glacial acetic acid and 44 parts of water. This gave a solution having a solids content of 40% and a viscosity of 107 mPa.s at 20° C.

EXAMPLE 6

48.4 parts of hexamethylene diisocyanate were added dropwise at 70° to 80° to 65.4 parts of N,N-dimethyl-N',N'-bis-(2-hydroxypropyl)-1,3-propanediamine, and the mixture was then stirred at 90° to 100° for 3 hours.

120 parts of 1,2-propanediol were then added, and 38 parts of benzyl chloride were added dropwise at 70° to 80°. After stirring for six hours at 70° to 80°, the mixture was diluted with 250 parts of water. About 100 parts of distillate were removed in a waterpump vacuum at 50° to 60° to remove unconverted components.

This gave a clear yellowish solution having a solids content of 45%.

After dilution to a concentration of 25%, the viscosity found was 13.6 mPa.s at 20°.

EXAMPLE 7

81 parts of N,N'-bis-(2-hydroxypropyl)-piperazine were dissolved in 150 parts of acetone, and 0.1 part of tin(II) octoate and then at 50° to 55° 64 parts of hexamethylene diisocyanate were added. After stirring for five hours at 50° to 60°, 100 parts of 1,2-propanediol were added, and the acetone was distilled off at 80° to 90 °. 63 parts of benzyl chloride were added, and the mixture was stirred at 80° to 90° for 5 hours. After dilution with 300 parts of water, the pH was adjusted to 5 with about 5 parts of acetic acid. About 100 parts of distillate were distilled off in a waterpump vacuum at 70° to 80° to remove volatile components. Addition of 160 parts of water gave a reddish-coloured solution having a solids content of 51%.

After dilution with water to a concentration of 40%, the viscosity found was 55.9 mPa.s.

EXAMPLE 8

76 parts of hexadecyl isocyanate are added at room temperature (RT) to 143 parts of polyethertetraol of the OH number 224 (average molecular weight: 1000) which has been prepared by the addition reaction first of propylene oxide (PO) and then ethylene oxide (EO) in a weight ratio of 55:45 with ethylenediamine, and the mixture is stirred at 80° C. for 2 hours. After the addition of 34 parts of hexamethylene diisocyanate (HDI), stirring at 80° C. is continued for another hour. 25 parts of N,N-bis-(dimethylaminopropyl)-N-(2-hydroxypropyl)-amine are then added to the reaction mixture, which is stirred at 80° C. until no more isocyanate can be detected by IR spectroscopy. 56 parts of benzyl chloride are then added, and the mixture is heated at 90° C. for another 3 hours. The resulting melt, cooled to 60° C., is dissolved in 779 parts of demineralized water. This gives a pale brown, slightly cloudy product having a solids content of about 30%.

pH: 7.3

Viscosity: 640 mPa.s/50° C.

EXAMPLE 9

63 parts of HDI are added at RT to 178.5 parts of polyetherdiol of the OH number 158 (average molecular weight: 709) which has been prepared by the addition reaction first of PO and then EO in a weight ratio of 80:20 with stearylamine, and the mixture is stirred at 90° C. for 3 hours. After the addition of 22.3 parts of N,N-dimethylaminoethanol, stirring at 90° C. is continued until no more isocyanate can be detected by IR spectroscopy. 57.2 parts of dimethyl sulphate are then added dropwise at 40° C. over a period of 30 minutes, the mixture is heated at 80° C. for another hour, and the resulting melt is dissolved in 748.8 parts of demineralized water. This gives a yellowish, almost clear product having a solids content of about 30%.

pH: 6.6

Viscosity: 420 mPa.s/25° C.

EXAMPLE 10

72.8 parts of HDI are added at RT to 119 parts of polyetherdiol of the OH number 158 (average molecular weight: 709) which has been prepared by the addition reaction first of PO and then EO in a weight ratio of 80:20 with stearylamine, and the mixture is stirred at 80° C. for 2 hours. After the addition of 19.8 parts of N-methyldiethanolamine, the mixture is stirred at 80° C. for another hour. 17.8 parts of dimethylaminoethanol are then added to the reaction mixture and stirring is continued at 80° C. until no more isocyanate can be detected by IR spectroscopy. 65.4 parts of benzyl chloride are then added, and the mixture is heated at 90° C. for another 3 hours. The resulting melt is dissolved at 60° C. in 688 parts of demineralized water. This gives a yellowish, almost clear product having a solids content of about 30%.

pH: 5.2

Viscosity: 3700 mPa.s/25° C.

EXAMPLE 11

100 parts of polyetherdiol of the OH number 224 (average molecular weight: 500) which has been prepared by the addition reaction first of PO and then EO in a weight ratio of 80:20 with benzylamine, 94 parts of HDI, 24 parts of N-methyldiethanolamine, 37 parts of diethylaminoethanol (instead of dimethylaminoethanol) and 66 parts of benzyl chloride are reacted analogously to Example 8, and the product is dissolved in 749 parts of demineralized water. This gives a pale brown, almost clear product having a solids content of about 30%.

pH: 6.8

Viscosity: 340 mPa.s/25° C.

EXAMPLE 12

100 parts of polyetherdiol of the OH number 224 (average molecular weight: 500) which has been prepared by the addition reaction of PO with N-methyldiethanolamine, 94 parts of HDI, 24 parts of N-methyldiethanolamine, 45 parts 95% pure 2-(2-dimethylaminoethoxy)-ethanol (instead of dimethylaminoethanol) and 66 parts of benzyl chloride are reacted analogously to Example 8, and the product is dissolved in 766 parts of demineralized water. This gives a pale brown, slightly cloudy product having a solids content of about 30%.

pH: 8.2

Viscosity: 34 mPa.s/25° C.

EXAMPLE 13

59 parts of HDI are added at RT to 125 parts of the polyetherdiol of the OH number 224 described in Example 12, and the mixture is stirred at 80° C. for 3 hours. After the addition of 43 parts of N,N-bis-(3-dimethylaminopropyl)-N-(2-hydroxypropyl)-amine, stirring at 80° C. is continued until no more isocyanate can be detected by IR spectroscopy. 75 parts of benzyl chloride are then added, and the mixture is heated at 90° C. for another 3 hours. The resulting melt is dissolved at 60° C. in 705 parts of demineralized water. This gives a yellowish, almost clear product having a solids content of about 30%.

pH: 8.0

Efflux viscosity: 14 s (4 mm Ford cup/25° C.)

EXAMPLE 14

Wool yarns which have been given a Hercosett 57 superwash finish (chlorination and treatment with an adipic acid/diethylenetriamine/epichlorohydrin reaction product) are treated at a liquor ratio of 20:1 at room temperature for 15 minutes with a dyeing liquor containing per liter 1.0 g of the dyestuff C.I. Acid Blue 49 (=No. 62,095)
2.0 g of anhydrous sodium sulphate
1.5 g of acetic acid (40% strength)
0.5 g of the levelling agent of the formula $$C_{18}H_{37}-\overset{\oplus}{\underset{\underset{CH_2}{|}}{\overset{\overset{CH_3}{|}}{N}}}-(CH_2-CH_2-O)_{30}-CH_2-CH_2-SO_3^{\ominus}$$

The dyebath is heated to boiling over a period of 60 minutes, and dyeing is carried out at this temperature for 60 minutes. The dyeing is then rinsed and is after-treated at 50° C. for 30 minutes with a liquor containing per liter 1.6 g of the reaction product according to Example 1 and 4.0 g of anhydrous sodium sulphate, which has been adjusted to pH 7.5 to 8.0 with ammonia solution, which does not cause any bleeding of the dyeing. The dyeing is then rinsed, acidified with acetic acid, dewatered and dried.

The tests for fastness show that the fastness level is considerably improved by the after-treatment so that the IWS specifications (IWS-TM 193, IWS-TM 174) are achieved; this takes place without deterioration of the rub fastness.

EXAMPLE 15

The wool yarns having a HERCOSETT finish are dyed as described in Example 14 and subsequently treated at 50° C. for 30 minutes with a liquor containing per liter 2.0 g of the reaction product according to Example 8 and
4.0 g of anhydrous sodium sulphate and adjusted to pH 7.5 to 8.0 with ammonia solution, which does not cause any bleeding of the dyeing. The dyeing is subsequently rinsed, acidified with acetic acid, dewatered and dried.

In this manner, a significant improvement in the fastness properties of the dyeing is achieved; this takes place without any deterioration of the rub fastness.

EXAMPLE 16

Wool tops which have previously been given a HERCOSETT 57 finish are introduced at a liquor ratio of 10:1 at room temperature into a dyebath containing per liter 1 g of the dyestuff C.I. Acid Red 296 (=No. 15,575)
1 g of anhydrous sodium sulphate
2.5 g of acetic acid (60% strength)
0.6 g of the levelling agent used in Example 14.

The dyeing liquor is then heated to boiling over a period of 30 minutes and maintained at this temperature for 60 minutes. After rinsing, the dyeing is after-treated at 50° C. over a period of 30 minutes with a liquor containing per liter 2.5 g of the reaction product according to Example 2 and 4.0 g of anhydrous sodium sulphate which has been adjusted to pH 7.5 to 8.0 with ammonia solution, which does not cause any bleeding of the dyeing. The dyeing is then rinsed, acidified with acetic acid, dewatered and dried. The dyeing has a significantly higher fastness level; this takes place without deterioration of the rub fastness.

EXAMPLE 17

Packages of wool yarn with a non-felting finish are dyed at a liquor ratio of 15:1, as described in Example 14, except that a dyeing liquor is used which contains per liter 1.6 g of the dyestuff C.I. Acid Green 50 (=C.I. 44,090)
0.75 g of anhydrous sodium sulphate
2.0 g of acetic acid (60% strength)
0.5 g of the reaction product from 1 mol of N-methyl-stearylamine and 30 mol of ethylene oxide.

The after-treatment is carried out as described in Example 14. The dyeing thus obtained has very good fastness properties, which are obtained without any deterioration of the rub fastness.

EXAMPLE 18

Hanks of wool yarn having a HERCOSETT 57 finish are introduced at room temperature at a liquor ratio of 25:1 into a dyeing liquor containing per liter 1.2 g of the red dyestuff from French Patent Specification No. 1,389,345, Example 1
2.0 g of anhydrous sodium sulphate
2.0 g of acetic acid (60% strength)
0.4 g of a mixture of auxiliaries consisting of 50 parts of the reaction product from 1 mol of N-methyl-stearylamine and 20 mol of EO and 50 parts of the reaction product from 1 mol of N-methyl-stearylamine and 35 mol of EO.

The procedure of the dyeing and the after-treatment as described in Example 14 are repeated, except that the after-treatment is carried out with 1.2 g of the reaction product according to Example 4.

In this case, too, a significant improvement of the fastness properties of the dyeing is obtained; this takes place without any deterioration of the rub fastness.

EXAMPLE 19

Wool tops which had previously been prechlorinated as usual are dyed at a liquor ratio of 10:1, as described in Example 14, and after-treated after rinsing at 50° C. for 5 minutes in a liquor which contains 4.8 g of the reaction product according to Example 12.

The pH of the treatment bath is then adjusted to a pH of about 7.5 to 8.0 by the addition of ammonia solution. The dyeing is treated at 50° C. for another 25 minutes. The tops are then rinsed, acidified with acetic acid, dewatered and dried.

The tests for fastness show that the fastness level has been improved significantly by the after-treatment so that the IWS specifications (IWS-TM 193 and IWS-TM 174) are achieved; this takes place without deterioration of the rub fastness.

EXAMPLE 20

Packages of wool yarn with a non-felting finish are dyed at a liquor ratio of 12:1, as described in Example 14, except that a dyeing liquor is used which contains per liter 1.0 g of the dyestuff C.I. Acid Green 50 (=C.I. 44 090)
1.0 g of anhydrous sodium sulphate
2.0 g of acetic acid (60% strength)
0.5 g of the reaction product from 1 mol of N-methyl-stearylamine and 30 mol of ethylene oxide.

The after-treatment is carried out as described in Example 14, except that the after-treatment is carried out with 3.2 g of the reaction product according to Example 11.

The dyeing thus obtained has very good fastness properties, which are obtained without any deterioration of the rub fastness.

EXAMPLE 21

Wool tops which have previously been given a HERCOSETT 57 finish are introduced at a liquor ratio of 10:1 at room temperature into a dyebath containing per liter 1 g of the dye C.I. Acid Red 296 (=No. 15 675)
1 g of anhydrous sodium sulphate
2.5 g of acetic acid (60%)
0.6 g of the levelling agent used in Example 14.

The dyeing liquor is then heated to boiling over a period of 60 minutes and maintained at this temperature for 60 minutes. After rinsing, the dyeing is after-treated at 50° C. over a period of 30 minutes with a liquor containing per liter 3.5 g of the reaction product according to Example 13 which has been adjusted to pH 7.5 to 8.0 with ammonia solution, which does not cause any bleeding of the dyeing. The dyeing is then rinsed, acidified with acetic acid, dewatered and dried. The dyeing has a significantly higher fastness level than the dyeing which has not been after-treated; this takes place without deterioration of the rub fastness.

We claim:

1. A process for the after-treatment of anionically dyed polyamide textile materials comprising contacting said materials with polyurethanes containing quaternary ammonium groups, wherein the polyurethanes are obtainable by reaction of (A) compounds containing tertiary amino groups and at least two hydroxyl groups comprising hydroxyalkylamines of the general formulae

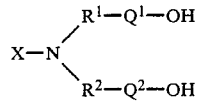

or

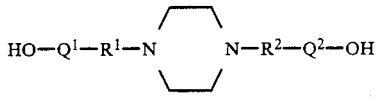

in which $Q^1$ and $Q^2$, independently of one another, denote a radical of the general formula

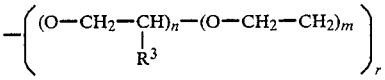

X denotes $C_1$–$C_{18}$-alkyl, $C_5$–$C_8$-cycloalkyl, $C_7$–$C_9$ aralkyl or a radical of the formula

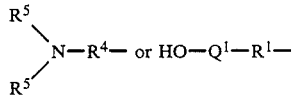

$R^1$, $R^2$ and $R^4$, independently of one another, denote $C_2$–$C_6$-alkylene, $C_5$–$C_8$-cycloalkylene or $C_7$–$C_9$-aralkylene, $R^3$ denotes hydrogen or methyl, $R^5$ denotes $C_1$–$C_{18}$-alkyl, $C_5$–$C_8$-cycloalkyl, $C_7$–$C_9$-aralkyl or a radical of the formula $$HO—Q^1—R^1—$$

and m, n and r denote a number from 0 to 30 with (B) polyisocyanates and (C) quaternizing agents.

2. A process according to claim 1, wherein the component (B) used in the preparation of the polyurethanes comprises aliphatic, cycloaliphatic, araliphatic or aromatic polyisocyanates.

3. A process according to claim 2, wherein the component (B) is an aliphatic diisocyanate.

4. A process according to claim 1, wherein component (A) is used in a mixture with other compounds (D) which are customary in polyurethane chemistry and contain at least two Zerewitinoff-active hydrogen atoms, said compounds (D) selected from the group consisting of polyesters, polyethers, polythioethers, polyacetals, polycarbonates and polyesteramides containing 2 to 4 hydroxyl groups.

5. A process according to claim 1, wherein (A) and (B) are reacted in the process of chain terminating agents (E).

6. A process according to claim 5, wherein (A) and (B) and, if present, (D) and/or (E) are reacted, while maintaining a ratio of isocyanate groups to groups which are reactive towards isocyanate groups of 0.8:1 to 1:1 at 20° to 150° C.

7. A process according to claim 1, wherein in the quaternization 0.7 to 1.0 equivalent of quaternizing agent is used per tertiary amino group of the resultant addition product and any remaining tertiary amino groups are protonated by treatment with acids.

8. A process according to claim 1, wherein the polyamide which is after-treated is wool.

9. A process according to claim 1, wherein the polyamide which is after-treated is wool with a non-felting finish.

10. A process according to claim 5, wherein the terminating agent is a monoalcohol, a monoamine, acetic hydrazide, stearyl hydrazide, aniline or a thiol compound.

11. A process according to claim 10, wherein the monoalcohol is methanol, N-octanol, isopropanol, isooctyl alcohol or stearyl alcohol.

12. A process according to claim 10, wherein the monoamine is ethylamine, di-n-butylamine, di-isopropylamine, stearylamine or 4-amino-2,2,6,6-tetramethylpiperidine.

* * * * *